US009304437B2

(12) United States Patent
Hashimoto

(10) Patent No.: US 9,304,437 B2
(45) **Date of Patent: *Apr. 5, 2016**

(54) DRUM UNIT FOR SUPPORTING DEVELOPER CARTRIDGE THAT INCLUDES DEVELOPING ROLLER

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/803,335

(22) Filed: Jul. 20, 2015

(65) Prior Publication Data

US 2015/0323885 A1 Nov. 12, 2015

Related U.S. Application Data

(63) Continuation of application No. 14/486,086, filed on Sep. 15, 2014, now Pat. No. 9,086,678, which is a continuation of application No. 14/036,386, filed on Sep. 25, 2013, now Pat. No. 8,837,980, which is a (Continued)

(30) Foreign Application Priority Data

Dec. 26, 2008 (JP) ..... 2008-334380

(51) Int. Cl.
*G03G 15/01* (2006.01)
*G03G 21/18* (2006.01)

(Continued)

(52) U.S. Cl.
CPC ..... *G03G 15/0865* (2013.01); *G03G 15/0813* (2013.01); *G03G 15/0875* (2013.01); *G03G 15/0896* (2013.01); *G03G 21/1647* (2013.01); *G03G 21/1676* (2013.01); *G03G 21/1842* (2013.01); *G03G 2221/1687* (2013.01); *G03G 2221/1815* (2013.01)

(Continued)

(58) Field of Classification Search
CPC ..... G03G 15/0875; G03G 15/0896; G03G 15/0813; G03G 21/1647; G03G 21/1676; G03G 21/1842; G03G 2221/1815; G03G 2221/1687
USPC ..... 399/113, 110, 112
See application file for complete search history.

(56) References Cited

U.S. PATENT DOCUMENTS 7,555,245 B2 6/2009 Kamimura
8,374,525 B2 2/2013 Hashimoto (Continued)

FOREIGN PATENT DOCUMENTS

JP 2007-178654 A 7/2007

*Primary Examiner* — Sophia S Chen
(74) *Attorney, Agent, or Firm* — Banner & Witcoff, Ltd.

(57) ABSTRACT

An image forming apparatus includes an apparatus body, a drum unit which holds photosensitive drums in parallel, a developing cartridge which is detachably mounted in the drum unit, a translation member which is provided in the apparatus body to be movable linearly, a shaft which is provided on the tandem photosensitive drum unit for each developing cartridge; and a pivoting member which is rotatably supported by the shaft. The pivoting member includes an abutting portion which is provided on one side to abut the translation member, a pressing portion which is provided on the other side, and is configured to press a predetermined portion of the developing cartridge in a direction in which the developing roller is separated from the photosensitive drum; and a spring portion which applies a biasing force in a direction in which the pressing portion is separated from the predetermined portion.

20 Claims, 14 Drawing Sheets

Related U.S. Application Data continuation of application No. 13/745,312, filed on Jan. 18, 2013, now Pat. No. 8,565,641, which is a continuation of application No. 12/646,061, filed on Dec. 23, 2009, now Pat. No. 8,374,525.

(51) Int. Cl.

| | |
|---|---|
| ***G03G 15/08*** | (2006.01) |
| ***G03G 21/16*** | (2006.01) |

(56) References Cited

U.S. PATENT DOCUMENTS

| | | | |
|---|---|---|---|
| 8,565,641 | B2 | 10/2013 | Hashimoto |
| 8,837,980 | B2 | 9/2014 | Hashimoto |
| 2007/0183814 | A1 | 8/2007 | Kamimura |
| 2007/0286639 | A1 | 12/2007 | Murayama |
| 2009/0175652 | A1 | 7/2009 | Kamimura |
| 2009/0220273 | A1 | 9/2009 | Tomatsu |
| 2010/0135693 | A1 | 6/2010 | Okabe et al. |

DRUM UNIT FOR SUPPORTING DEVELOPER CARTRIDGE THAT INCLUDES DEVELOPING ROLLER

CROSS-REFERENCE TO RELATED APPLICATION

This application is a continuation of prior U.S. application Ser. No. 14/486,086, filed Sep. 15, 2014, which is a continuation of prior U.S. application Ser. No. 14/036,386, filed Sep. 25, 2013, now U.S. Pat. No. 8,837,980 B2, issued Sep. 16, 2014, which is a continuation of prior U.S. application Ser. No. 13/745,312, filed Jan. 18, 2013, now U.S. Pat. No. 8,565,641 B2, issued Oct. 22, 2013, which is a continuation of prior U.S. application Ser. No. 12/646,061, filed Dec. 23, 2009, now U.S. Pat. No. 8,374,525 B2, issued Feb. 12, 2013, which claims priority from Japanese Patent Application No. 2008-334380, filed on Dec. 26, 2008, the entire contents of which are incorporated herein by reference.

TECHNICAL FIELD

Aspects of the present invention relate to an image forming apparatus, such as a color laser printer.

BACKGROUND

As an electrophotographic color printer, a tandem electrophotographic color printer in which photosensitive drums corresponding to yellow, magenta, cyan, and black colors, respectively, are arranged in parallel with each other is known.

The tandem color printer is provided with a developing device which holds a developing roller so as to oppose each photosensitive drum. An electrostatic latent image is formed on the surface of the photosensitive drum. When the electrostatic latent image opposes the developing roller with the rotation of the photosensitive drum, toner is supplied to the electrostatic latent image from the developing roller, so that a toner image is formed on the surface of the photosensitive drum. Specifically, for color image formation, toner images of colors corresponding to the photosensitive drums, respectively, are formed, and the toner images of the respective colors are superposed on and transferred to a sheet conveyed by a belt. For monochrome image formation, only a black toner image is formed on a photosensitive drum for black, and the black toner image is transferred to a sheet.

At monochrome image formation, since any toner image is not formed on the photosensitive drums for yellow, magenta, and cyan other than black, it is advantageous to separate developing rollers from the photosensitive drums to reduce or prevent the wear of the developing rollers.

A tandem image forming apparatus includes a translation cam member which is linearly movable in an array direction of photosensitive drums, and an intermediate member which is displaced by the linear movement of the translation cam member, and presses a developing device upward to separate a photosensitive drum from a developing roller. Specifically, the linear movement of the translation cam member realize switching among an all-color separation state where developing rollers are separated from all the photosensitive drums, a black contact state where a developing roller contacts a photosensitive drum for black, and other developing rollers are separated from photosensitive drums for yellow, magenta, and cyan, respectively, and an all-color contact state where the developing rollers contact all the photosensitive drums, respectively.

Additionally, in the tandem image forming apparatus, the photosensitive drums for four colors are collectively held in a drum unit, and the drum unit is detachably mounted in an apparatus body. Further, developing devices for respective colors are detachably mounted in the drum unit.

However, in the above-described tandem image forming apparatus, when a developing device is pressed upward by the intermediate member, the position of the drum unit with respect to the apparatus body may deviate by the forced applied to the developing device from the intermediate member. If the position of the drum unit deviates, the position of an image to be formed on a sheet deviates with the deviation.

SUMMARY

It is an aspect of the present invention to provide an image forming apparatus which can prevent the position of a photosensitive drum unit with respect to an apparatus body from deviating when a developing roller is separated from a photosensitive drum.

According to an exemplary embodiment of the present invention, there is provided an image forming apparatus comprising: an apparatus body; a tandem photosensitive drum unit which holds a plurality of photosensitive drums to be in parallel with each other, and is movably mounted in the apparatus body along an array direction of the photosensitive drums; a developing cartridge which is provided for each of the photosensitive drums, supports a developing roller for supplying developer to the corresponding photosensitive drum, and is detachably mounted in the tandem photosensitive drum unit; a translation member which is provided in the apparatus body to be movable linearly in the array direction; a first supporting shaft which is provided on the tandem photosensitive drum unit for each of the developing cartridges; and a pivoting member which is rotatably supported by the first supporting shaft. The pivoting member includes: an abutting portion which is provided on one side with respect to the first supporting shaft to abut the translation member along the linear movement of the translation member; a pressing portion which is provided on the other side with respect to the first supporting shaft, opposes a predetermined portion of the developing cartridge, and is configured to press the predetermined portion in a direction in which the developing roller is separated from the photosensitive drum along the linear movement of the translation member after the translation member abuts on the abutting portion; and a spring portion which is configured to apply a biasing force in a direction in which the pressing portion is separated from the predetermined portion.

According to another exemplary embodiment of the present invention, there is provided an image forming apparatus comprising: an apparatus body; a drum unit which holds a photosensitive drum and is movably mounted in the apparatus body; a developing cartridge which supports a developing roller for supplying developer to the drum unit; a translation member which is provided in the apparatus body to be movable linearly; a supporting shaft which is provided on the drum unit; and a pivoting member. The pivoting member includes: a supported part which is rotatably supported by the supporting shaft; a first part which is provided at a first side with respect to the supported part, and arranged at a position which is able to abut the translation member along the linear movement of the translation member; and a second part which is provided at a second side opposite to the first side with respect to the supported part, and is able to abut the developing cartridge when the pivoting member is rotated about the supported part while the translation member presses the first part.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described below in detail with reference to the accompanying drawings.

1. Printer

Figure 1:
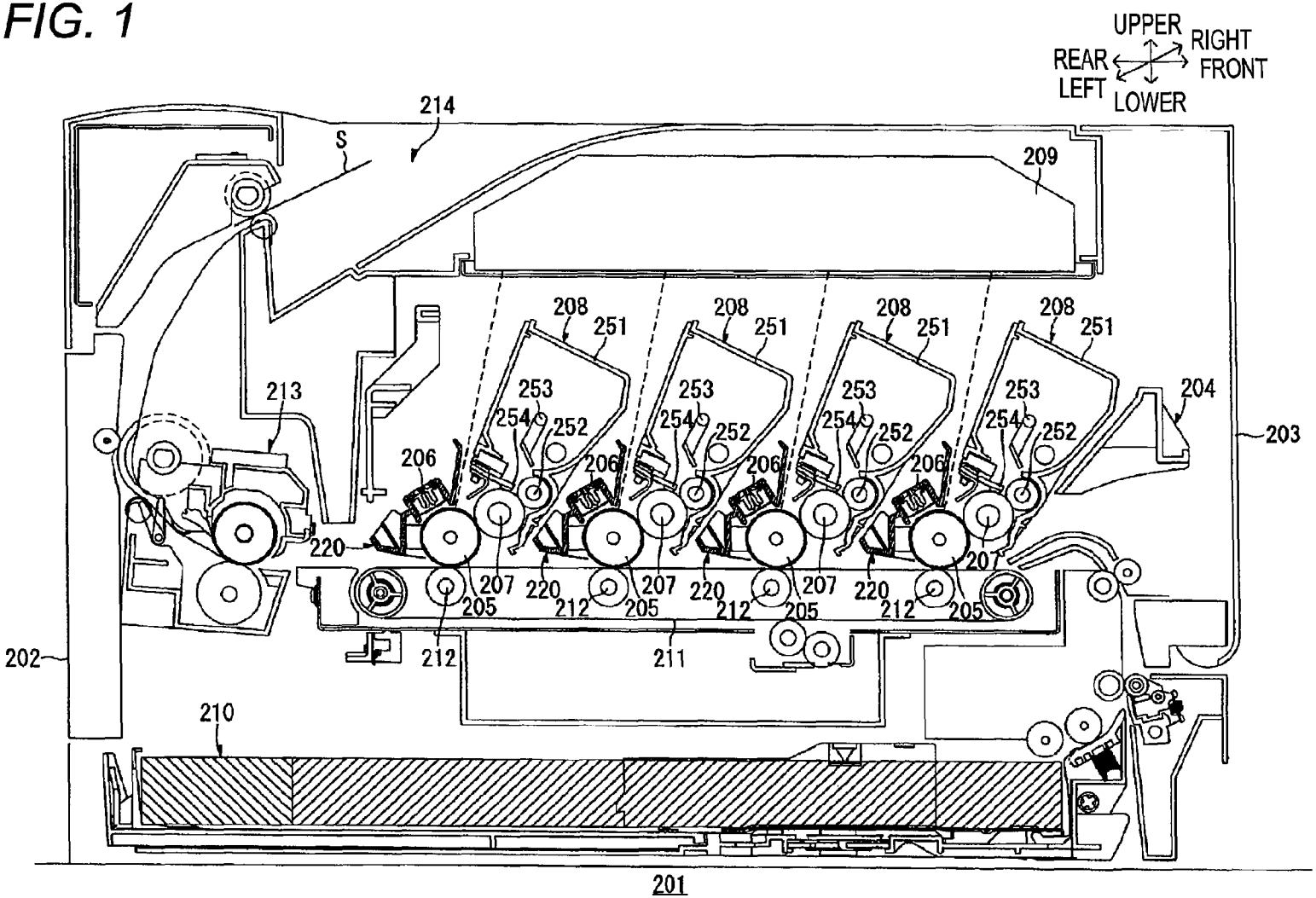
FIG. 1 is a sectional side view showing a printer as an example of an image forming apparatus according to an exemplary embodiment of the present invention.

A printer 201 is shown in FIG. 1 as an example of an image forming apparatus according to an exemplary embodiment of the present invention. For ease of discussion, in the following description, directions are defined as viewed from a user who operates the printer 201. The top or upper side, the bottom or lower side, the left or left side, the right or right side, the front or front side, and the rear or rear side of the printer 201 are identified as indicated by the arrows in drawings. Further, herein the left-right direction is also referred to as a width direction, and the upper-lower direction is also referred to as a vertical direction. The left-right direction and the front-rear direction are also referred to as a horizontal direction. With regard to various individual components of the printer 201, sides of the individual components are similarly identified based on the arranged/attached position of the components on/in the printer 201.

A printer 201 is a tandem color laser printer. The printer 201 includes a body casing 202 (as an example of an apparatus body). A front cover 203 is openable and closably provided on one side face of the body casing 202.

A drum unit 204 (as an example of a tandem photosensitive drum unit) is provided within the body casing 202. The drum unit 204 is mounted in and detached from the inside of the body casing 202 via an opening formed in the front face of the body casing 202 in a state where the front cover 203 has been opened.

Four photosensitive drums 205 are provided along the front-rear direction in the drum unit 204 in a state where the drums 205 are rotatable. A scorotron type charger 206 and a developing roller 207 are provided to oppose each photosensitive drum 205. Additionally, a developing cartridge 208 which supports the developing roller 207 and stores toner (developer) is provided adjacent to each photosensitive drum 205. The developing cartridge 208 is mountable in and detachable from the drum unit 204. The toner of the developing cartridge 208 is carried on the surface of the developing roller 207.

After the surface of each photosensitive drum 205 is uniformly charged by the charger 206, the surface is exposed by a laser beam (refer to a dashed arrow) emitted from a scanner unit 209 provided in an upper part of the body casing 202. This causes an electrostatic latent image based on image data to be formed on the surface of each photosensitive drum 205. The electrostatic latent image of each photosensitive drum 205 is visualized into a toner image by the toner carried on the surface of the developing roller 207 corresponding to each photosensitive drum 205. Here, since the color of the toner stored in each developing cartridge 208 differs according to each developing cartridge 208, the color of a toner image on each photosensitive drum 205 differs according to each photosensitive drum 205.

A sheet feed cassette 210 which stores sheets S is provided at the bottom of the body casing 202. The sheets S stored in the sheet feed cassette 210 is conveyed onto a conveyor belt 211 by various rollers. The conveyor belt 211 is provided to oppose the four photosensitive drums 205 from below. A transfer roller 212 is provided at each position opposing the photosensitive drum 205 with an upper part of the conveyor belt 211 therebetween. A sheet S conveyed onto the conveyor belt 211 passes between the conveyor belt 211 and each photosensitive drum 205 sequentially by the traveling of the conveyor belt 211. Then, a toner image on the surface of the photosensitive drum 205 is transferred to the sheet S by a transfer bias applied to the transfer roller 212 when the toner image opposes the sheet S.

A fixing device 213 is provided on the downstream side of the conveyor belt 211 in the conveying direction of the sheet S. The sheet S to which the toner image has been transferred is conveyed to a fixing device 213. In the fixing device 213, the toner image is fixed on the sheet S by heating and pressurization. The sheets S on which the toner image has been fixed is discharged by a sheet discharge tray 214 on the upper face of the body casing 202 by various rollers.

2. Drum Unit

Figure 2:
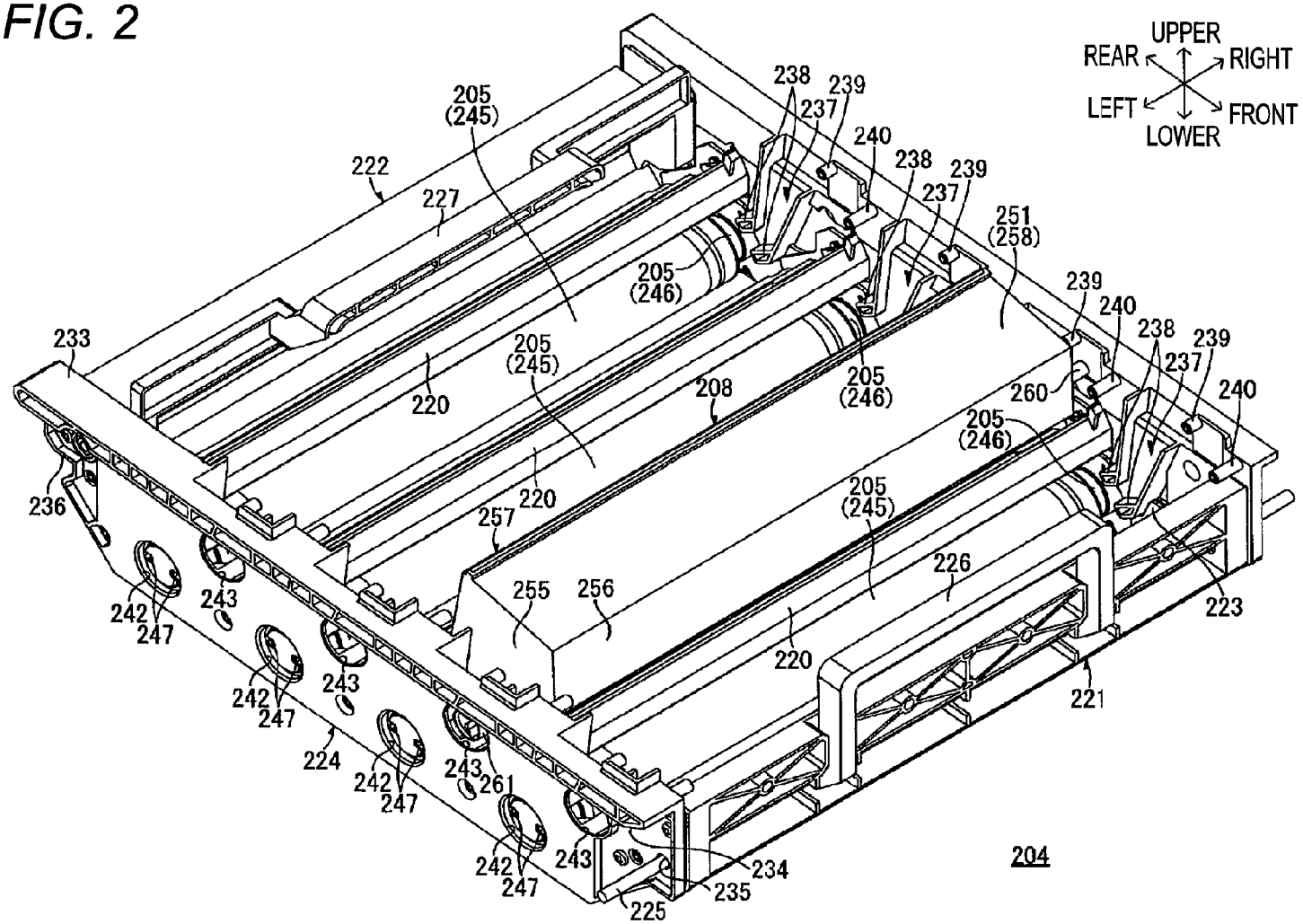
FIG. 2 is a perspective view seen from the upper front left side of a drum unit, in which one developing cartridge is mounted, and the other developing cartridges have been detached.

As shown in FIG. 2, the drum unit 204 includes, as a unit, four photosensitive drums 205, four developing cartridges 208, four drum subunits 220, a front beam 221, a rear beam 222, a pair of first side plates 223, and a pair of second side plates 224, and is slidably mounted in and detached from the inside of the body casing 202 (refer to FIG. 1).

(1) Drum Subunit

The four drum subunits 220 are provided at intervals in the front-rear direction between the pair of first side plates 223. Each drum subunit 220 is made of resin, is elongated in the width direction, and is formed in the shape of a substantially triangular prism which is opened to the lower front side. The charger 206 shown in FIG. 1 and a cleaning member (not shown), for the cleaning of the surface of the photosensitive drum 205, are held in each drum subunit 220.

(2) Front Beam

The front beam 221 is made of resin. The front beam 221 is provided between front ends of the pair of first side plates 223.

The front beam 221 holds a supporting shaft 225. The supporting shaft 225 passes through the front beam 221 along the width direction, protrudes outward in the width direction from the front beam 221, and protrudes outward in the width direction through the first side plates 223 and the second side plates 224.

A front-side grip portion 226 is rotatably supported by the supporting shaft 225. The front-side grip portion 226 is provided at the central portion of the front beam 221 in the width direction. The front-side grip portion 226 is substantially U-shaped, and is provided so as to be rotatably supported by the supporting shaft 225 at each free end, and switchable between a housed position where the grip portion rises along the front beam 221 and an operation position where the grip portion is tilted to the front side of the front beam 221.

(3) Rear Beam

The rear beam 222 is made of resin. The rear beam 222 is provided between rear ends of the pair of first side plates 223.

A rear-side grip portion 227 is integrally formed at the central portion of the upper face of the rear beam 222 in the width direction. The rear-side grip portion 227 is substantially U-shaped in rear view, and is provided so as to be connected to the rear beam 222 at each free end, and incline from the lower rear side to the upper front side to protrude obliquely upward from the rear beam 222.

(4) First Side Plate

The right and left first side plates 223 are made by press working of a metal sheet using the same press die, and have the same shape.

Figure 5:
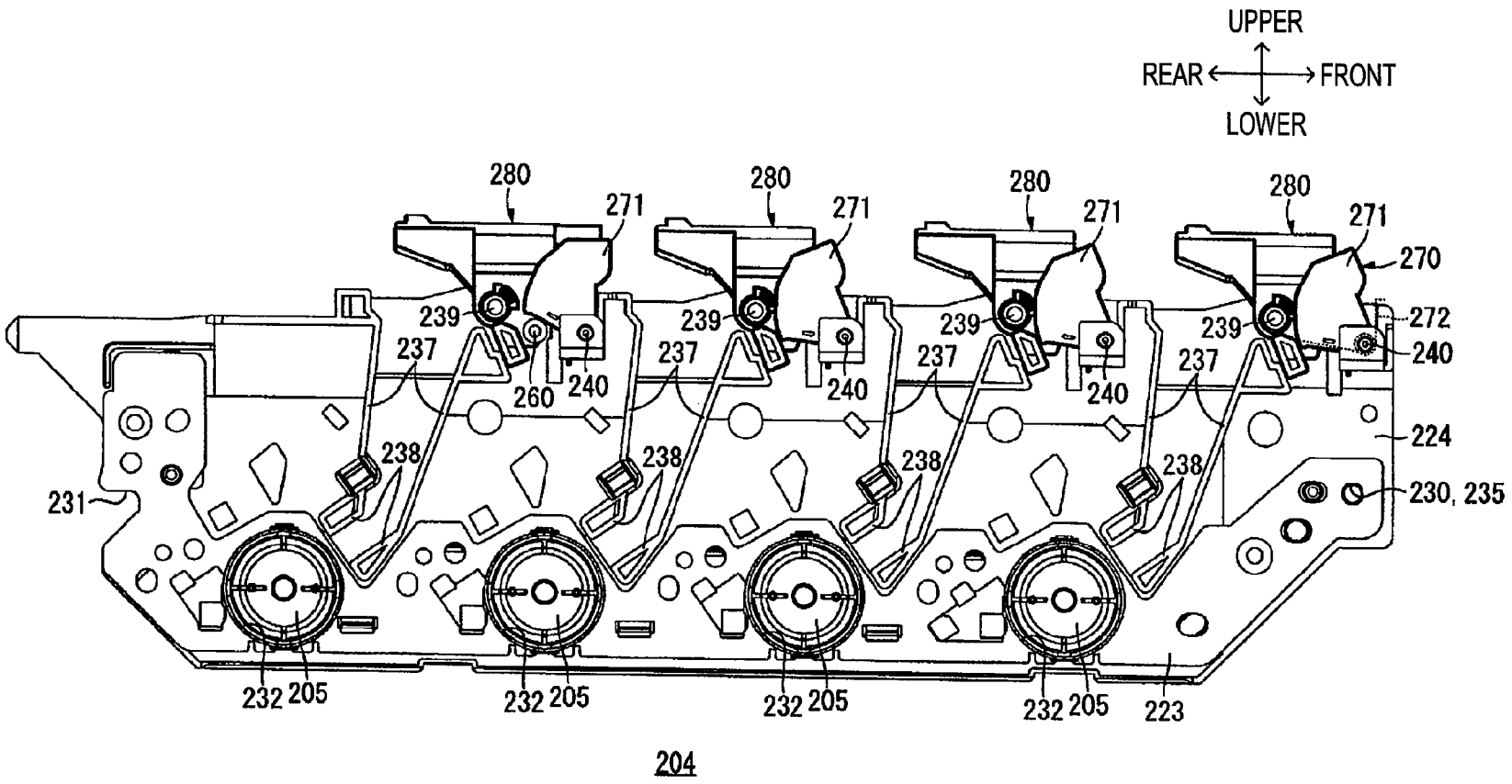
FIG. 5 is a left side view when a portion of the drum unit is cut.

The first side plates 223, as shown in FIG. 5, are formed in the shape of a substantially elongated rectangular plate which extends in the front-rear direction. The front end and rear end of each first side plate 223 oppose the front beam 221 and rear beam 222 shown in FIGS. 2 and 3, respectively, in the right-left direction.

The front end of the first side plate 223 extends towards the upper front side. A supporting shaft insertion hole 230 is formed at the front end of the first side plate 223 so as to pass therethrough. The supporting shaft 225 is inserted through the supporting shaft insertion hole 230.

The rear end of the first side plate 223 is formed in a substantial L-shape in side view. More specifically, the rear end of the first side plate 223 inclines towards the upper rear side, and is formed in a shape which extends towards the upper side.

The rear end of the first side plate 223 is formed with a cutout portion 231 which is cut out in a substantial V-shape from the rear end edge of the first side plate. Specifically, the cutout portion 231 is formed in a shape having an upper end edge which extends in the front-rear direction in side view, a lower end edge which inclines at a predetermined gradient towards the upper front side, and a front end edge which connects the front end of the upper end edge and the front end of the lower end edge.

The first side plate 223 is formed with four circular drum supporting holes 232. The drum supporting holes 232 are formed at predetermined intervals in the front-rear direction between the front end and rear end of the first side plate 223. The end of the photosensitive drum 205 in the width direction is inserted through each drum supporting hole 232. Accordingly, each photosensitive drum 205 is held between the pair of first side plates 223.

(5) Second Side Plate

The second side plate 224 is made of, for example, fiber reinforced resin. The second side plate 224, as shown in FIG. 5, is formed in the shape of a substantially elongated rectangular plate in side view which is wide in the upper-lower direction and is almost the same length in the front-rear direction as compared with the first side plate 223. The front end and rear end of the second side plate 224 oppose the front beam 221 and rear beam 222 shown in FIGS. 2 and 3, respectively, in the right-left direction.

Figure 6:
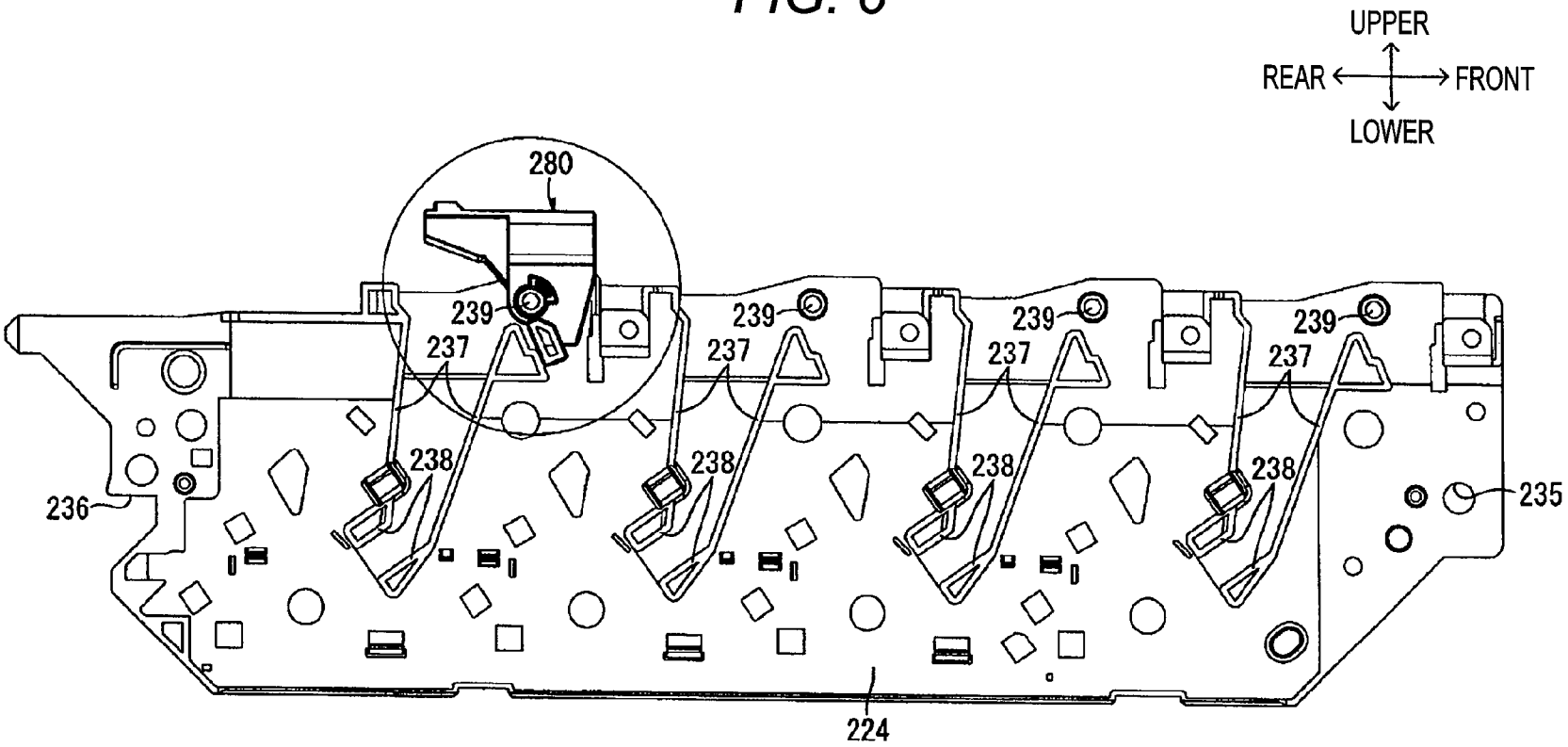
FIG. 6 is a left side view of a second right side plate.

As shown FIG. 6, the front end of the second side plate 224 is formed narrower in the upper-lower direction than a middle portion of the second side plate 224, and the lower end edge of the second side plate 224 inclines towards the upper front side. Additionally, the rear end of the second side plate 224 is formed narrower in the upper-lower direction than the middle portion of the second side plate 224, and the lower end edge of the second side plate inclines towards the upper rear side.

Figure 3:
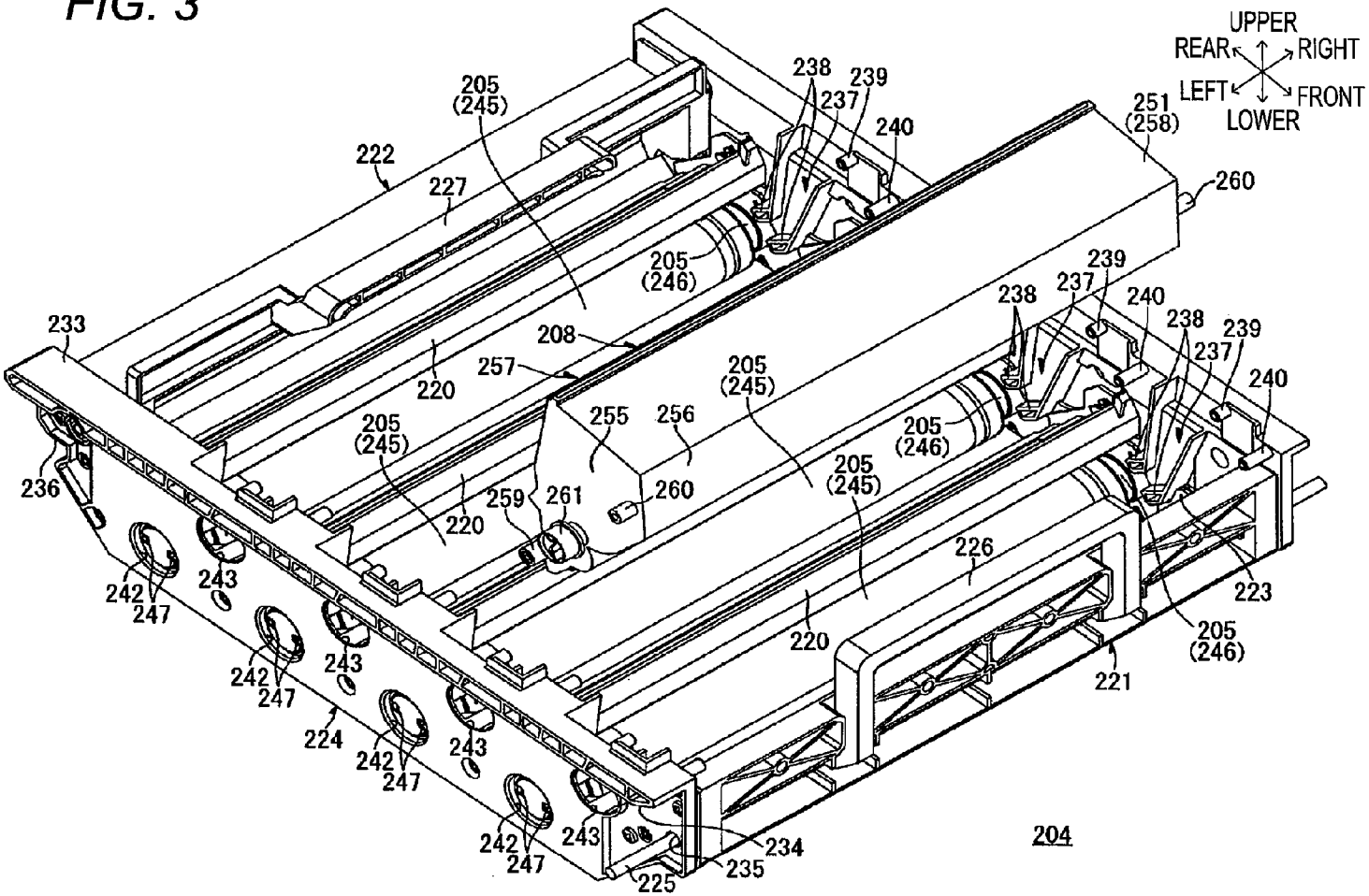
FIG. 3 is a perspective view seen from the upper front left side of the drum unit, in which one developing cartridge is being mounted and detached, and the other developing cartridges have been detached.
Figure 4:
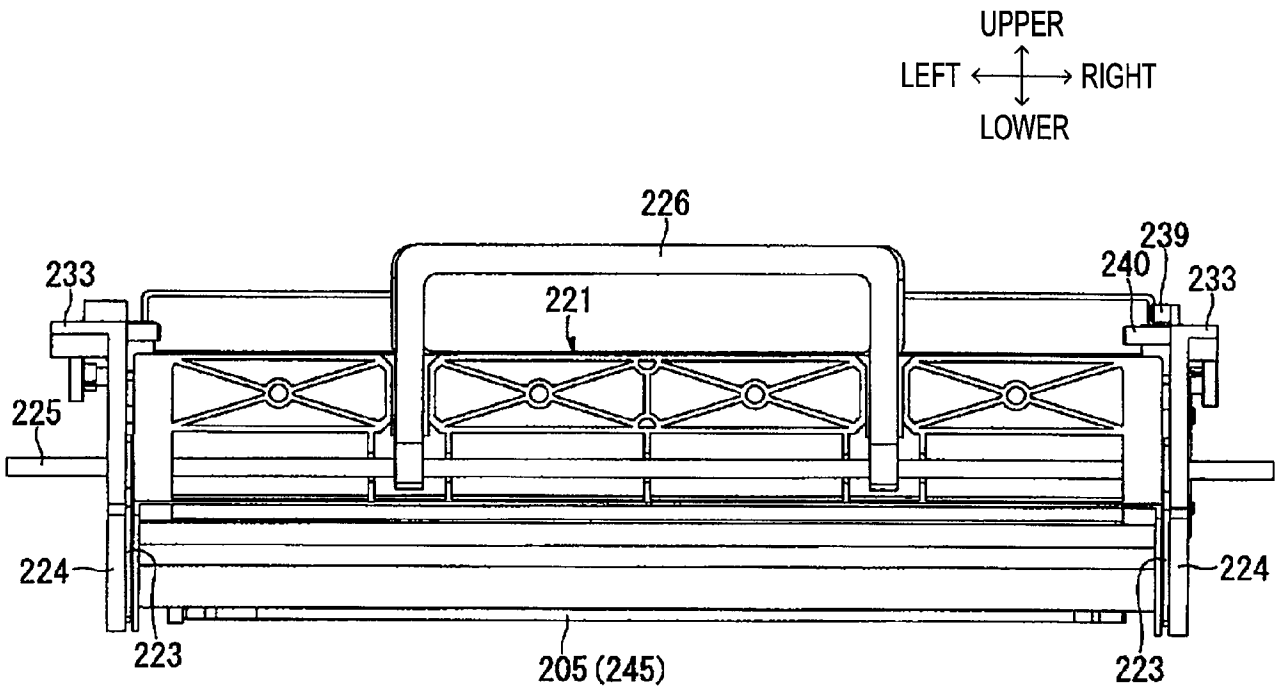
FIG. 4 is a front view of the drum unit.

As shown in FIGS. 2 and 3, the upper end of each second side plate 224 is formed with a flange portion 233 which extends outward in the width direction and extends in the front-rear direction. The front end of the flange portion 233 is formed with an inclined surface 234 which inclines towards the upper front side from below face of the flange portion 233.

As shown in FIG. 6, the front end of the second side plate 224 is formed with a supporting shaft insertion hole 235. The supporting shaft insertion hole 235 is formed at a position opposing the supporting shaft insertion hole 230 (refer to FIG. 5) of the first side plate 223 in the width direction.

As shown in FIG. 6, the rear end of the second side plate 224 is formed with a cutout portion 236. The cutout portion 236 is formed in almost the same shape as the cutout portion 231 in the position opposing the cutout portion 231 (refer to FIG. 5) of the first side plate 223 in the width direction.

Four cartridge guide portions 237 for guiding the mounting and detaching of the developing cartridge 208 (refer to FIGS. 2 and 3) in/from the right and left second side plates 224 are formed at predetermined intervals in the front-rear direction on the faces (the right side face of the left second side plate 224 and the left side face of the second right side plate 224) inside the second side plates 224 in the width direction. Each cartridge guide portion 237 is formed from two ridges which protrude towards the inside in the width direction from the internal surface of the second side plate 224 and are formed at predetermined intervals. The cartridge guide portion 237 inclines at a predetermined gradient towards the lower rear side from the upper end of the second side plate 224, and is connected with a cartridge holding portion 238. The cartridge holding portion 238 is formed parallel to a line which connects the center of the photosensitive drum 205 and the center of the developing roller 207 which are shown in FIG. 1, and the lower end thereof is opened towards the photosensitive drum 205.

Additionally, four first supporting shafts 239 are provided at predetermined intervals in the front-rear direction at the upper end of the internal surface of the second side plate 224 so as to protrude therefrom. Additionally, four second supporting shafts 240 are provided at predetermined intervals in the front-rear direction at the upper end of the internal surface of the second side plate 224 so as to protrude therefrom. The second supporting shafts 240 are arranged in spaced positions ahead of the first supporting shafts 239, respectively.

A pivoting member 280 is rotatably supported by each first supporting shaft 239. Additionally, a pressing cam 271 (as an example of a pressing member) is rotatably supported by each second supporting shaft 240. The detailed configuration of the pivoting member 280 and the pressing cam 271 will be described below.

(5-1) Left Second Side Plate

As shown in FIGS. 2 and 3, the left second side plate 224 is formed with a drum coupling insertion hole 242 which exposes the axial left end of each photosensitive drum 205.

Four drum coupling insertion holes 242 are formed at predetermined intervals in the front-rear direction at the lower end of the second side plate 224. Each drum coupling insertion hole 242 is formed as a circular hole passing through the second side plate 224 in the thickness direction in the position where the insertion hole opposes the axial left end of each photosensitive drum 205 and the drum supporting hole 232 provided in the first side plate 223 in the width direction.

Additionally, a development coupling insertion hole 243 is formed in the position ahead of and above each drum coupling insertion hole 242 in the left second side plate 224. Although the development coupling insertion hole 243 is not shown in FIGS. 2 and 3, the insertion hole is arranged between two ridges of each cartridge guide portion 237 formed on the internal surface of the left second side plate 224, and passes through the second side plate 224 in the thickness direction. As shown in FIG. 2, a development coupling 261 provided to the left side face of the developing cartridge 208 opposes each development coupling insertion hole 243 in a state where each developing cartridge 208 is mounted between the right and left second side plates 224.

(6) Pressing Mechanism

As shown in FIG. 5, the drum unit 4 includes four pressing mechanisms 270. Each pressing mechanism 270 includes a pressing cam 271 (as an example of a pressing member), and a pressing spring 272 (as an example of a spring) which resiliently presses the pressing cam 271 towards the lower rear side.

The pressing cam 271 has a substantially triangular plate shape in side view. The second supporting shaft 240 of the second side plate 224 is inserted into one corner of the pressing cam 271. Accordingly, the pressing cam 271 is rotatably supported with respect to the second side plate 224. The pressing cam 271 is provided in such a posture that the pressing cam 271 extends obliquely towards the upper rear side from one corner supported by the second supporting shaft 240.

The pressing spring 272, as shown by a dashed line in FIG. 5, is wound around the second supporting shaft 240, and has one end locked to the second side plate 224 and the other end locked to the pressing cam 271.

(7) Pivoting Member

Figure 7A:
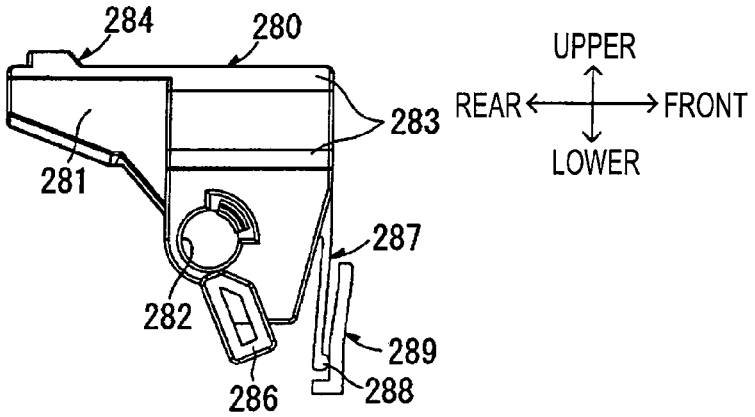
FIG. 7A is a side view of a pivoting member and showing a portion of the second side plate.

As shown in FIG. 5, the drum unit 4 includes four pivoting members 280. The pivoting member 280 is made of resin material, and as shown in FIG. 7A, includes a main body 281 having a substantially triangular plate shape in side view. Specifically, the upper end edge of the main body 281 extends in the front-rear direction. The front end edge of the main body 281 extends downward from the front end of the upper end edge, and extends obliquely towards the lower rear side from the middle portion of the main body. The rear end edge of the main body 281 inclines towards the upper rear side from the lower front side so that the lower end of the front end edge and the rear end of the upper end edge are connected together.

A shaft hole 282 is formed as a circular hole passing through the main body 281 in the right-left direction at the middle portion of the rear end edge of the main body 281. As shown in FIG. 5, the first supporting shaft 239 provided in the second side plate 224 is inserted through the shaft hole 282. Accordingly the pivoting member 280 is rotatably supported with respect to the second side plate 224.

Figure 7B:
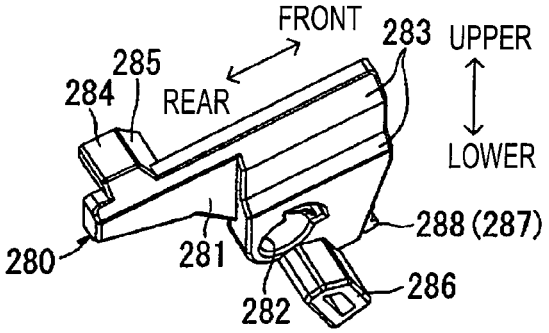
FIG. 7B is a perspective view of the pivoting member seen from the upper rear left side.

As shown in FIG. 7B, two guide portions 283 are formed on the left side face of the main body 281. Each guide portion 283 extends along the front-rear direction, and inclines towards the lower left side from the upper right side.

Figure 7C:
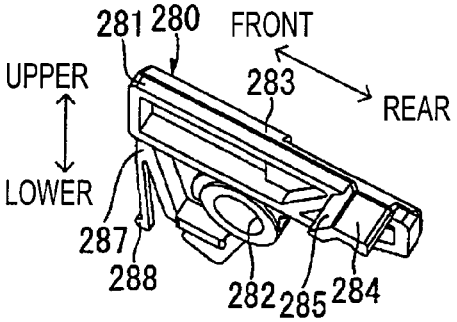
FIG. 7C is a perspective view of the pivoting member seen from the upper rear right side.

Additionally, as shown in FIGS. 7B and 7C, the pivoting member 280 includes an abutting portion 284 which protrudes to the right from the rear end of the upper end edge of the main body 281. The abutting portion 284 has a substantially trapezoidal shape in side view, and forms an inclined surface 285 whose front end face inclines towards the lower front side from the upper rear side.

Additionally, the pivoting member 280 includes a pressing portion 286 which protrudes to the left from the lower end of the rear end edge of the main body 281. The pressing portion 286 has a substantially rectangular shape in side view, extends in a direction along the radial direction of a shaft hole 282, and is arranged in such a posture that inclines so that the upper end thereof is located on the upper rear side and the lower end thereof is located on the lower front side in a state where FIG. 7A is shown.

Additionally, as shown in FIG. 7A, the pivoting member 280 includes a spring portion 287. The spring portion 287 is formed integrally with the main body 281, and has an elongated thin plate shape which extends vertically downward from a middle portion of the front end edge of the main body 281. Thereby, the spring portion 287 has a resiliently deformable spring property. The lower end of the spring portion 287 has a projection 288 which protrudes forward.

Meanwhile, the second side plate 224 is provided with an abutting wall 289 on which the projection 288 of the spring portion 287 abuts. The abutting wall 289 extends inward in the width direction from the internal surface of the second side plate 224, and has a substantially inverted L shape in side view.

(7-1) Resilient Deformation of Spring Portion

Figure 8:
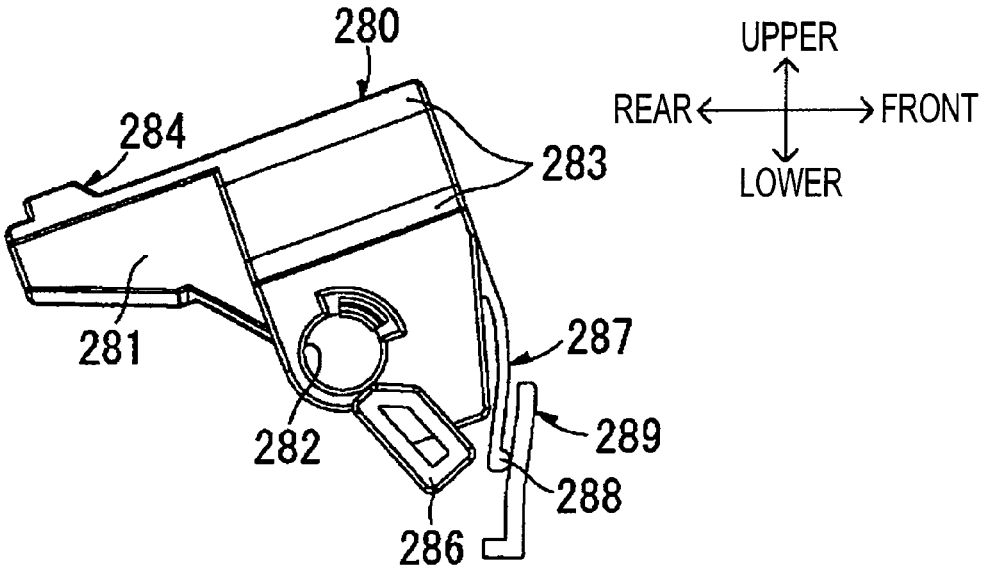
FIG. 8 is a side view of the pivoting member when the pivoting member has been rotated in a direction in which a developing cartridge is moved from a first position to a second position.

As shown in FIG. 8, when the pivoting member 280 is rotated in a direction in which the pivoting member 280 moves the developing cartridge 208 (refer to FIGS. 2 and 3) from a first position to a second position, that is, in the counterclockwise direction in FIG. 8 about the first supporting shaft 239 (refer to FIG. 5) inserted through the shaft hole 282, the projection 288 of the spring portion 287 moves upwards along the rear side face of the abutting wall 289. At this time, the middle portion of the spring portion 287 resiliently deforms so as to bulge in a direction radially outward of the shaft hole 282 with the movement of the projection 288. In this state, the spring portion 287 has a biasing force of rotating the pivoting member 280 in the clockwise direction in FIG. 8.

(8) Photosensitive Drum

As shown in FIGS. 2 and 3, the photosensitive drum 205 includes a cylindrical drum body 245, and two flange portion members 246 which are fitted into both ends of the drum body 245 to be non-rotatable with each other.

The uppermost surface layer of the drum body 245 is formed by a photosensitive layer having a positively charged property.

The flange portion members 246 are made of resin material, and portions thereof are inserted into both ends of the drum body 245. The left end face of the left flange portion member 246 is formed with a coupling groove 247. A driving transmission portion (not shown) provided in the body casing 202 is coupled with the coupling groove 247. Thereby, as shown in FIG. 1, the driving force from the driving transmission portion is transmitted to the photosensitive drum 205 in a state where the drum unit 204 is mounted into the body casing 202, so that the photosensitive drum 205 can be rotated.

The right and left flange portion members 246 are supported by bearing members (not shown), respectively, so as to be rotatable with respect to the drum supporting holes 232 (refer to FIG. 5) of the first side plate 223.

3. Developing Cartridge

As shown in FIG. 1, the developing cartridge 208 includes a box-shaped developing frame 251 which is opened to the lower rear side. The developing roller 207, a supply roller 252, an agitator 253, and a thickness regulating blade 254 are provided within the developing frame 251.

The developing roller 207 is configured such that a portion of the peripheral surface is exposed towards the lower front side from the developing frame 251, and abuts the peripheral surface of the photosensitive drum 205 from the upper front side in a state where the developing cartridge 208 is mounted to the drum unit 204.

The supply roller 252 is provided in the position ahead of and above the developing roller 207, and the peripheral surface thereof pressure contacts the peripheral surface of the developing roller 207.

The agitator 253 is provided in an upper position within the developing frame 251 to be rotatable about a shaft which extends in the width direction. The thickness regulating blade 254 has one end fixed to the developing frame 251 and the other end resiliently abutting on the peripheral surface of the developing roller 207. Toner corresponding to each color is stored in the developing frame 251.

The toner within the developing frame 251 is supplied to the supply roller 252 while being agitated within the developing frame 251 by the rotation of the agitator 253. The toner supplied to the supply roller 252 is supplied to the developing roller 207 by the contact between the supply roller 252 and the developing roller 207. The toner supplied to the developing roller 207 is regulated in thickness by the thickness regulating blade 254 with the rotation of the developing roller 207, and is carried on the peripheral surface of the developing roller 207 as a thin layer with a predetermined thickness. Accordingly, when an electrostatic latent image formed on the peripheral surface of the photosensitive drum 205 opposes the developing roller 207, the toner is supplied to the electrostatic latent image from the developing roller 207, and the electrostatic latent image is developed.

(1) Developing Frame

As shown in FIG. 3, the developing frame 251 has a pair of right and left side walls 255, a front wall 256, a rear wall 257 and an upper wall 258 which connect the pair of side walls 255 together, and has a substantially triangular shape in side view.

Both axial ends of a roller shaft 259 of the developing roller 207 (refer to FIG. 1) pass through the lower ends of the side walls 255, and protrude outward in the width direction.

Additionally, a development pressed boss 260 (as an example of a pressed portion) is provided in an upper front position in each side wall 255 so as to protrude outward in the width direction from the side wall 255.

Additionally, in the left side wall 255, a development coupling 261 is provided in an upper front position of the roller shaft 259. The development coupling 261 is connected to a plurality of gears (not shown) for transmitting a rotational driving force to the developing roller 207 and the supply roller 252 (refer to FIG. 1).

As shown in FIG. 2, each development coupling 261 opposes each development coupling insertion hole 243 in a state where each developing cartridge 208 is mounted to the drum unit 204. Then, the driving transmission portion (not shown) for transmitting the driving force from a motor (not shown) provided in the body casing 202 (refer to FIG. 1) is inserted through each development coupling insertion hole 243. As each driving transmission portion is coupled with each development coupling 261, the rotational driving force can be transmitted to the developing roller 207 and the supply roller (refer to FIG. 1) via each driving transmission portion and the development coupling 261.

(2) Mounting of Developing Cartridge in Drum Unit

As shown in FIG. 3, the developing cartridge 208 for each color is mounted between the right and left second side plates 224 from above. At this time, both ends of the roller shaft 259 which protrude from both the side walls 255 of the developing frame 251 of the developing cartridge 208 are introduced to the cartridge guide portions 237 from above while being guided inward in the width direction by the guide portions 283 (refer to FIGS. 7A and 7B) of the pivoting member 280. Then, the developing cartridge 208 is moved downward while other ends of the roller shaft 259 are guided to the cartridge guide portions 237. When the developing cartridge 208 is guided to the cartridge holding portion 238 (refer to FIG. 5), and as shown in FIG. 1, the developing roller 207 contacts the photosensitive drum 205, further push-in of the development cartridge 208 is regulated, and the developing roller 207 is positioned on the photosensitive drum 205. Thereafter, the developing cartridge 208 slightly inclines to the front side. Thereby, as shown in FIG. 5, the developing pressed boss 260 of the developing cartridge 208 passes between the pressing cam 271 and the pressing portion 286 of the pivoting member 280 and arranged below the pressing cam 271, thereby lifting the pressing cam 271 against a biasing force caused by the pressing spring 272 from below. Accordingly, the developing pressed boss 260 is biased downward by the pressing cam 271, and the developing cartridge 208 is pressed downward. In this state, the pressing portion 286 of the pivoting member 280 is arranged in the position slightly apart from the developing pressed boss 260.

4. Internal Structure of Body Casing

Figure 10:
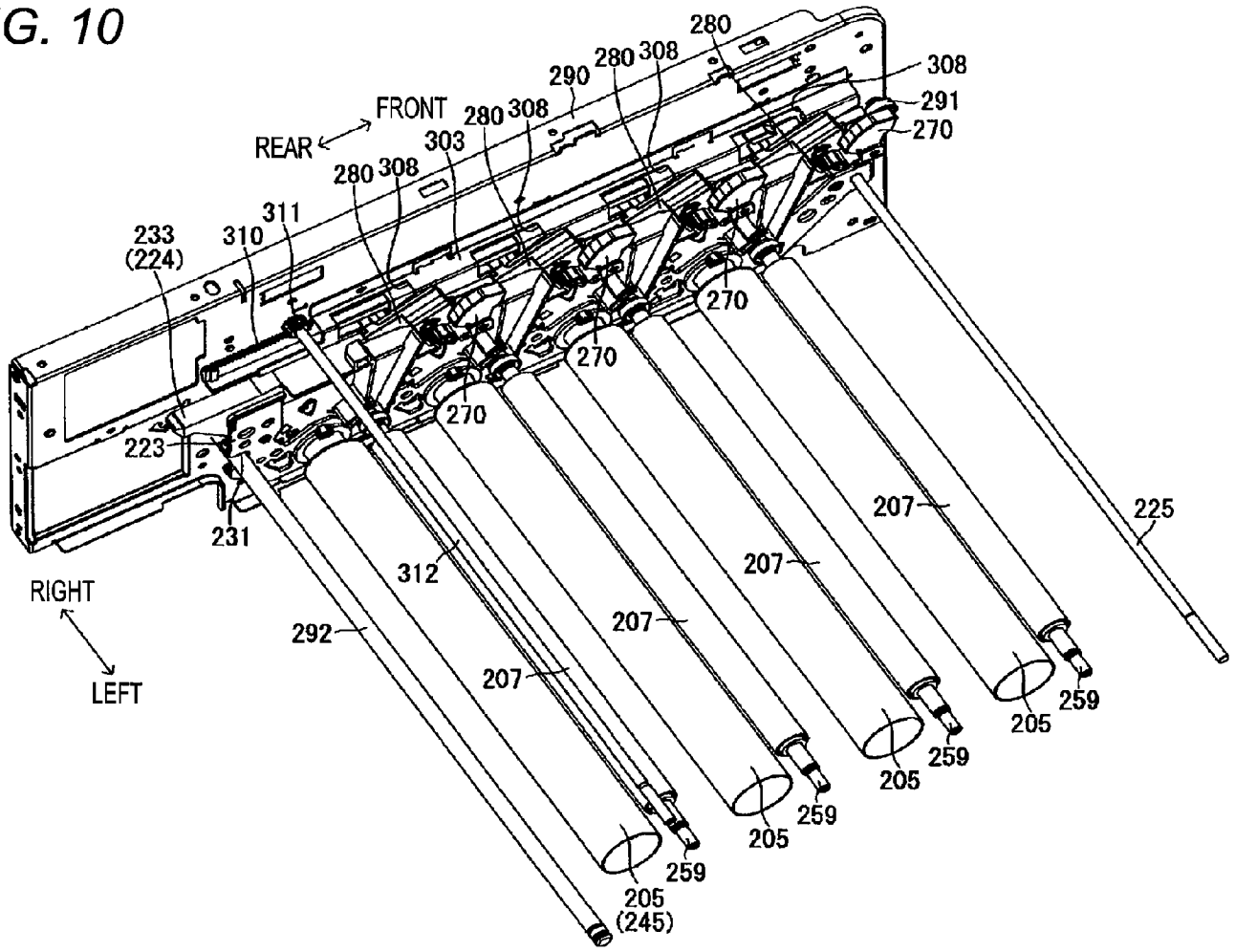
FIG. 10 is a perspective view showing a state where all the developing cartridges have been separated from the photosensitive drums, respectively.

As shown in FIG. 10, a pair of body side plates 290 which oppose each other at a distance from each other in the width direction is provided within the body casing 202. In the respective drawings after FIG. 10, only the right body side plate 290 is shown.

The front end of the body side plate 290 is provided with a roller member 291 which abuts the flange portion 233 of each second side plate 224 of the drum unit 204 from below, and slidably guides the drum unit 204 to the inside of the body casing 202. The roller member 291 is rotatably supported by a shaft (not shown) which extends inward in the width direction from the body side plate 290.

Additionally, one body reference shaft 292 is provided to extend between the rear ends of the right and left body side plates 290. When the drum unit 204 is mounted into the body casing 202, first, the front cover 203 (refer to FIG. 1) of the body casing 202 is opened. Then, the rear end edge of the flange portion 233 of the second side plates 224 of the drum unit 204 is abutted on the roller member 291 from above. Then, by moving the drum unit 204 rearward, the flange portion 233 of the second side plate 224 slides on the roller member 291, and the drum unit 204 is guided into the body casing 202. As the roller member 291 abuts on the inclined surface 234 (refer to FIGS. 2 and 3) provided on the front side of the flange portion 233, when the cutout portion 231 of the first side plate 223 abuts on the body reference shaft 292 from the upper front side after the drum unit 204 has moved downward on the whole, further push-in of the drum unit 204 is regulated. Thereby, the mounting of the drum unit 204 into the body casing 202 is completed.

The detachment of the drum unit 204 from the body casing 202 is performed by reverse operation to one described above.

5. Separating Mechanism

The body casing 202 is provided with a separating mechanism. The separating mechanism is configured to displace each developing cartridge 208 to the first position where each developing cartridge contacts the corresponding photosensitive drum 205, and the second position where each developing cartridge is separated from the corresponding photosensitive drum 205.

The separating mechanism includes translation cams 302 (as an example of a translation member), rails 303 which hold the translation cams 302, respectively, so as to be linearly movable in the front-rear direction, and a synchronous moving mechanism for synchronously linearly moving the pair of translation cams 302.

(1) Translation Cam

A pair of translation cams 302 is provided on both sides in the right-left direction within the body casing 202. Only the right translation cam 302 is shown in FIG. 10. Since the right and left translation cams 302 have the same construction, only the right translation cam 302 will be described below.

Figure 9:
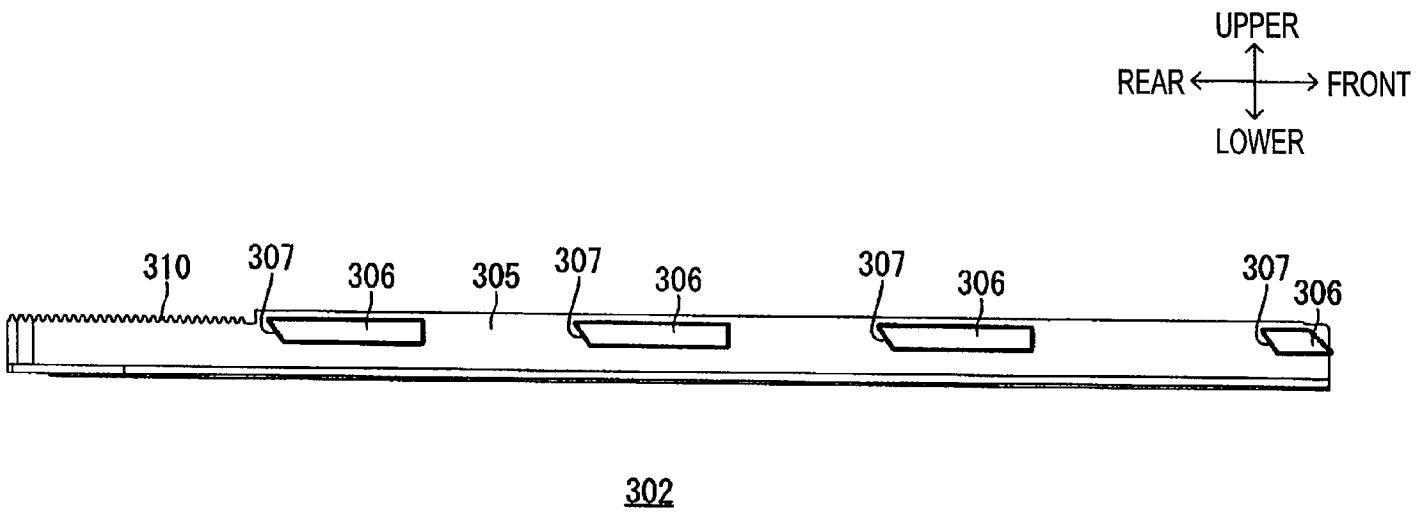
FIG. 9 is a side view of a translation cam.

As shown in FIG. 9, the translation cam 302 integrally includes a main body 305, and four cam portions 306 provided on the internal surface of the main body 305.

The main body 305 is formed in a substantially elongated rectangular shape which extends in the front-rear direction. The rear end of the main body 305 is cut out in a rectangular shape in side view from the upper face thereof, and a rack gear 310 is formed at the upper end edge of the main body. Additionally, the main body 305 is formed in a substantial L-shape in section, and the lower end edge thereof is bent inward in the width direction.

The four cam portions 306 are provided corresponding to the developing cartridges 208 (refer to FIG. 3) for respective colors. The cam portions 306 protrude inward in the width direction at predetermined intervals on the internal surface of the main body 305, and are formed in a substantially rectangular shape in side view. The rear end of each cam portion 306 forms an inclined surface 307 which inclines towards the upper rear side from the lower end edge thereof.

Three rear cam portions (three cam portions 306 other than the frontmost cam portion 306) are formed so that the intervals between the cam portions 306 which are adjacent to each other are equal. The frontmost cam portion 306 is formed so that the interval from the cam portion 306 which is adjacent to the frontmost cam portion is larger than the interval between the three rear cam portions 306.

(2) Rail

The rails 303 are provided on both sides in the right-left direction within the body casing 202. Since the right and left rails 303 have the same construction, only the right rail 303 will be described below.

As shown in FIG. 10, the rail 303 extends in the front-rear direction, and is formed in a substantial U-shape in section, and each free end thereof is fixed to the body side plate 290.

In the rail 303, four cutout portions 308 obtained by cutting out the rail 303 in a substantially rectangular shape in side view from the upper end edge of the rail are formed in the positions corresponding to the developing cartridges 208, respectively, in a state where the drum unit 204 is mounted into the body casing 202 (refer to FIGS. 2 and 3). Additionally, the rear end of the rail 303 is formed such that the bottom face of the rail extends further rearward than the upper face and left face of the rail.

The translation cam 302 is arranged inside the U-shaped portion of the rail 303, so that the cam portion 306 protrudes inward in the width direction. The translation cam 302 is slidably provided along the rail 303, and the rear end of the translation cam 302 is always exposed upward from the rear end of the rail 303 irrespective of the position of the translation cam 302.

(3) Synchronous Moving Mechanism

The synchronous moving mechanism is adapted to transmit the driving force for linear movement to left translation cam 302 from the right translation cam 302, for example, with the linear movement of the right translation cam 302.

That is, the synchronous moving mechanism includes a right rack gear 310 which is formed on the upper face of the rear end of the right translation cam 302, a right pinion gear 311 which meshes with the right rack gear 310, a left rack gear which is formed on the upper face of the rear end of the left translation cam 302 (not shown), a left pinion gear (not shown) which meshes with the left rack gear, and a connecting shaft 312 to which the right pinion gear 311 and the left pinion gear are attached to be non-rotatable with each other.

The driving force is input to the left translation cam 302 from a motor (not shown).

(4) Separating/Pressing Operation

Figure 11:
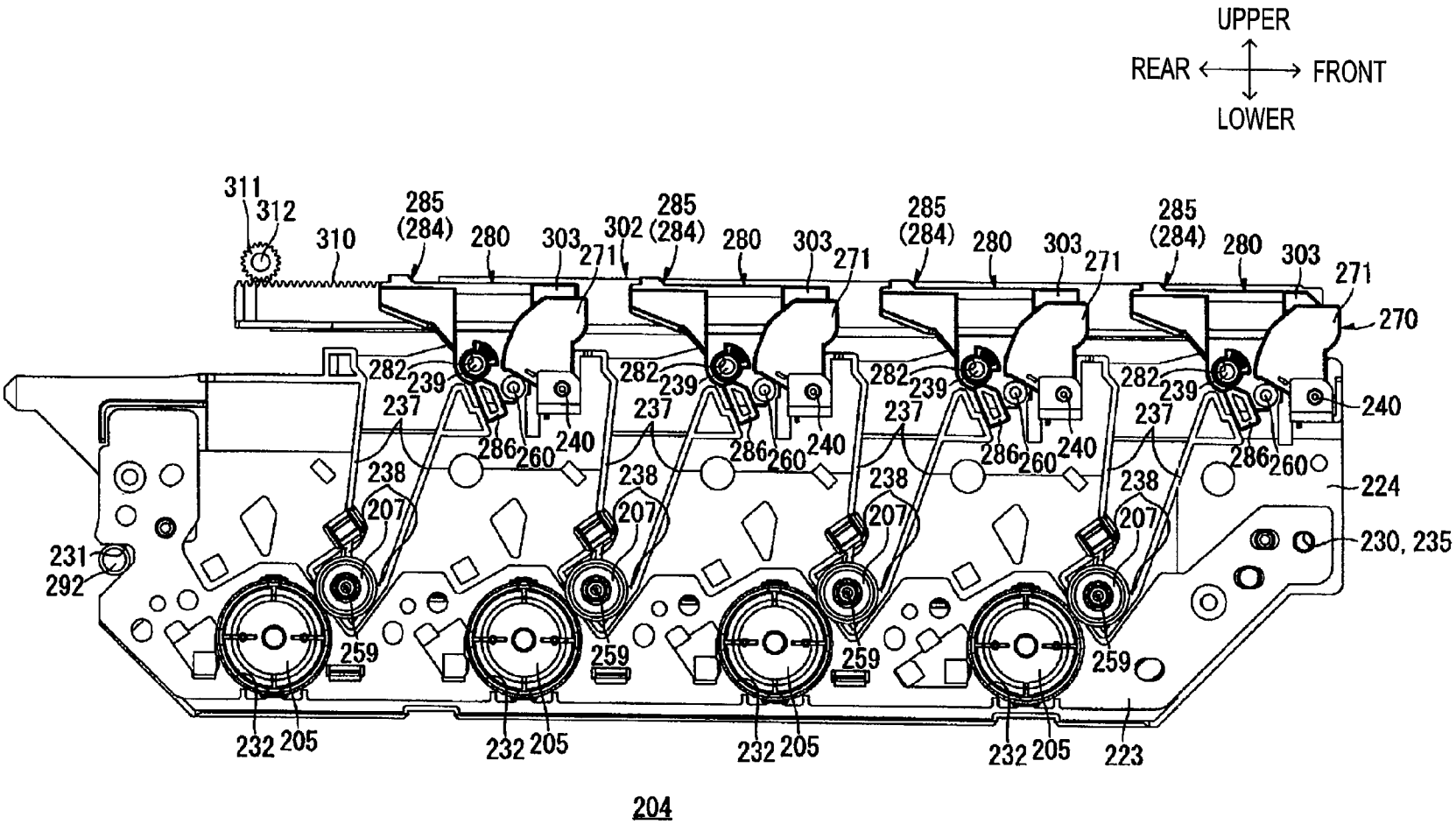
FIG. 11 is a right side view when a portion of the drum unit is cut, and showing a state where all the developing cartridges pressure-contact the photosensitive drums, respectively.

The operation of the separating mechanism will be described mainly referring to FIGS. 11 to 14. As shown in FIG. 11, in a state where the drum unit 204 is mounted into the body casing 202 (refer to FIG. 1), and the translation cam 302 is moved to the frontmost position, the inclined surface 307 (refer to FIG. 9) of each cam portion 306 and the abutting portion 284 of the pivoting member 280 arranged behind the inclined surface face each other in a non-contact state at an interval in the front-rear direction. The interval between the inclined surface 307 of the frontmost cam portion 306 and the abutting portion 284 of the pivoting member 280 arranged behind the inclined surface corresponding thereto is larger than the interval between the inclined surface 307 of each of the three rear cam portions 306 and the abutting portion 284 of the pivoting member 280 arranged behind the inclined surface corresponding thereto.

In this state, each developing cartridge 208 is arranged in a contact position where the developing roller 207 and the photosensitive drum 205 contact with each other. Each pressing cam 271 abuts the developing pressing boss 260 of each developing cartridge 208 from above, and presses each developing pressed boss 260 downward. In this state, as shown in FIG. 7A, the projection 288 of the spring portion 287 of the pivoting member 280 abuts the lower end of the abutting wall 289.

When the driving force of the motor (not shown) is input to an input rack gear (not shown) of the left translation cam 302 and the left translation cam 302 is moved rearward from the state shown in FIG. 11, the left pinion gear 311 rotates with the movement of the left translation cam 302, the rotation of the left pinion gear 311 is transmitted to the right pinion gear 311 via the connecting shaft 312, and the right pinion gear 311 rotates in the same direction as the left pinion gear 311 whereby the right translation cam 302 moves rearward.

When the rearward movement of the translation cam 302 proceeds, the inclined surface 307 of each of the three cam portions 306 abuts the abutting portion 284 of the pivoting member 280 arranged below and behind the inclined surface, thereby pressing the abutting portion 284 of each of the three pivoting member 280 towards the lower rear side. Accordingly, the pivoting member 280 is rotated so that the pressing portion 286 is lifted upward with the first supporting shaft 239 inserted through the shaft hole 282 as a fulcrum. During the rotation of the pivoting member 280, the pressing portion 286 of each pivoting member 280 abuts the developing pressed boss 260 located above the pressing portion from below, and pushes up the developing pressed boss 260. Therefore, the developing cartridges 208 corresponding to yellow, magenta, and cyan colors, respectively are lifted up against a pressing force applied from the pressing cam 271.

Figure 12:
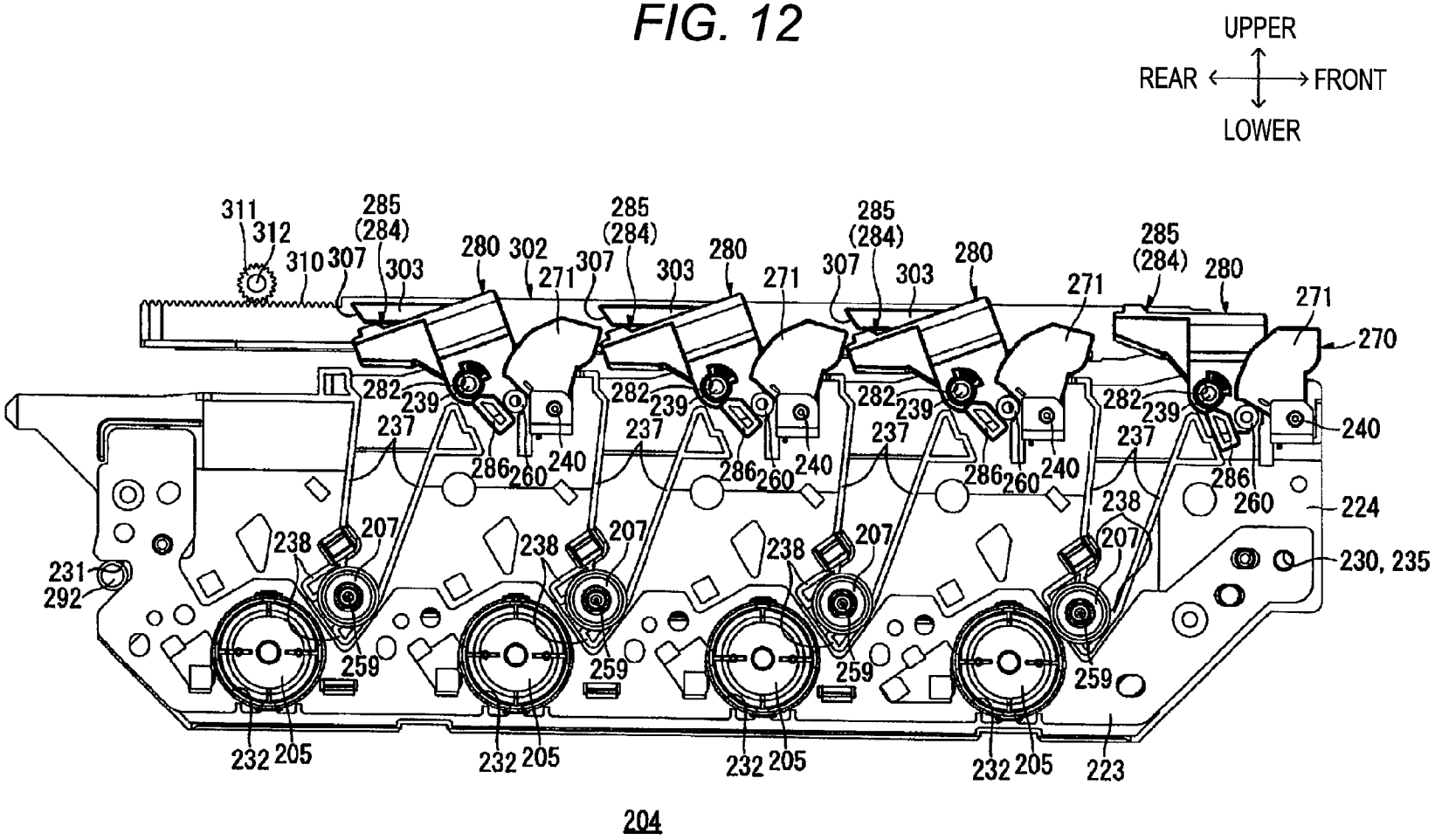
FIG. 12 is a right side view when a portion of the drum unit is cut, and showing a state where only a developing cartridge for black pressure-contacts a photosensitive drum.

Then, when the rearward movement of the translation cam 302 further proceeds, and as shown in FIG. 12, the abutting portion 284 of the pivoting member 280 abuts the bottom faces of the three rear cam portions 306, the developing cartridges 208 corresponding to yellow, magenta, and cyan colors, respectively, are arranged in the second position, and the developing roller 207 of each developing cartridge 208 is separated from the photosensitive drum 205. At this time, the developing pressed boss 260 of the developing cartridge 208 for black is pressed by the pressing cam 271. Therefore, only the developing roller 207 of the developing cartridge 208 for black is pressed against the photosensitive drum 205.

At this time, as shown in FIG. 8, the projection 288 of the spring portion 287 of the pivoting member 280 corresponding to each of the three rear cam portions 306 is moved upward along the abutting wall 289. Accordingly, the middle portion of the spring portion 287 is bent so as to bulge in a direction radially outward of the shaft hole 282, and the biasing force which biases the pivoting member in the clockwise direction in FIG. 8 acts on the pivoting member 280.

Thereafter, when the rearward movement of the translation cam 302 further proceeds from the state shown in FIG. 12, the inclined surface 307 of the frontmost cam portion 306 abuts on the abutting portion 284 of the pivoting member 280 arranged behind the inclined surface, thereby pressing the one end of the frontmost pivoting member 280 towards the lower rear side. Accordingly, the pivoting member 280 is rotated so that the pressing portion 286 is lifted upward with the first supporting shaft 239 as a fulcrum. During the rotation of the pivoting member 280, the pressing portion 286 of the pivoting member 280 abuts the developing pressed boss 260 located above the pressing portion from below, and pushes up the developing pressed boss 260. Therefore, developing cartridge 27 for black is lifted upward against a pressing force applied from the pressing cam 271.

Figure 13:
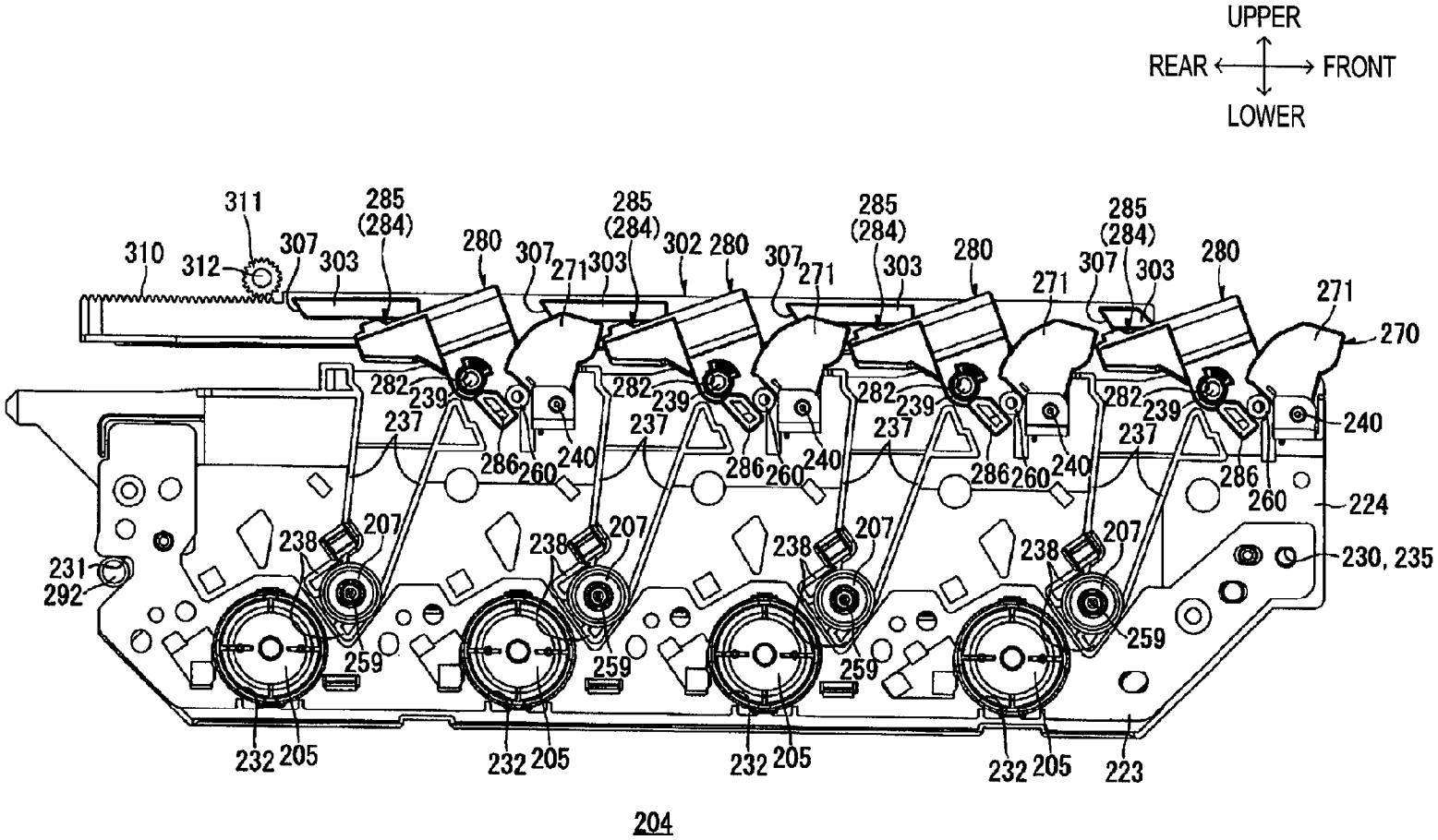
FIG. 13 is a right side view when a portion of the drum unit is cut, and showing a state where all the developing cartridges are separated from the photosensitive drums, respectively.

Then, when the rearward movement of the translation cam 302 further proceeds, and as shown in FIG. 13, the abutting portion 284 of the pivoting member 280 abuts the bottom face of the frontmost cam portion 306, the developing cartridge 208 for black is arranged in the second position, and the developing roller 207 of the developing cartridge 208 for black is separated from the photosensitive drum 205. Accordingly, all the developing rollers 207 of the developing cartridges 208 are separated from the photosensitive drums 205, respectively.

Figure 14:
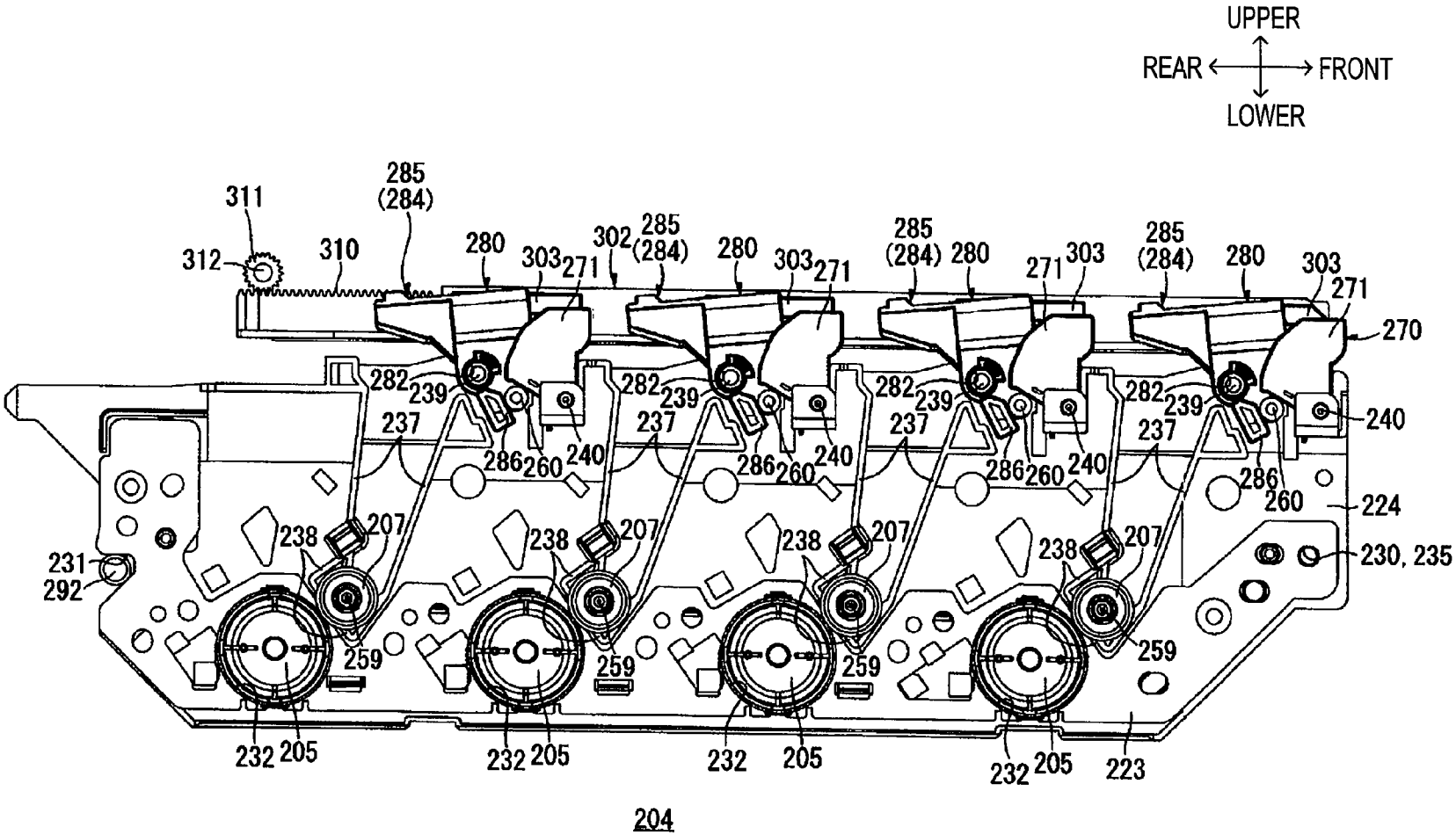
FIG. 14 is a right side view when a portion of the drum unit is cut, and showing a state where all the developing cartridges pressure-contact the photosensitive drums, respectively, immediately before a pressing portion of the pivoting member is separated from the developing cartridges.

Additionally, the translation cam 302 can be returned to the states shown in FIGS. 11 and 12, respectively, from the state shown in FIG. 13 by moving the translation cam forward. At this time, when the inclined surface 307 of each cam portion 306 and the abutting portion 284 of the pivoting member 280 located behind the inclined surface, the upward force applied to the developing pressing boss 260 from the pivoting member 280 is released. Then, as shown in FIG. 14, the developing cartridge 208 is pressed downward by the pressing cam 271, and the developing roller 207 and the photosensitive drum 205 are arranged in a contact position where the developing roller 207 and the photosensitive drum 205 make contact with each other.

Additionally, as the pressing portion 286 is pressed by the developing pressing boss 260, each pivoting member 280 rotates in a direction in which the pressing portion 286 moves downward. Then, after the developing pressed boss 260 is returned to the position where the developing roller 207 and the photosensitive drum 205 contact with each other, the pivoting member further rotates in a direction in which the pressing portion 286 moves downward by the biasing force (the stability of the spring portion 287) of the spring portion 287 (refer to FIG. 7A).

6. Advantages

As described above, the four photosensitive drums 205 are held in the drum unit 204 to be in parallel with each other. The developing cartridges 208 support the developing rollers 207, respectively, and are detachably mounted to the drum unit 204. The pivoting member 280 is provided in the drum unit 204 for each developing cartridge 208. Each pivoting member 280 is rotatably supported by the first supporting shaft 239 provided so as to protrude from the drum unit 204. The drum unit 204 is movably mounted in the body casing 202 along the front-rear direction. The translation cam 302 is provided in the body casing 202 so as to be movable linearly in the front-rear direction. The abutting portion 284 is provided on one side of the pivoting member 280 with respect to the first supporting shaft 239. The translation cam 302 abuts the abutting portion 284 along the linear movement thereof. The pressing portion 286 is provided on the other side of the pivoting member 280 with respect to the first supporting shaft 239. The pressing portion 286 opposes the developing pressed boss 260 of the developing cartridge 208, and presses the developing pressed boss 260 in a direction in which the developing roller 207 is separated from the photosensitive drum 205 with the linear movement after the abutment of the translation cam 302 on the abutting portion 284. The pivoting member 280 includes the spring portion 287. The spring portion 287 is configured to apply a biasing force in a direction in which the pressing portion 286 is separated from the developing pressed boss 260.

The pressing portion 286 of the pivoting member 280 opposes the developing pressed boss 260 of each developing cartridge 208 in a state where each developing cartridge 208 is mounted in the drum unit 204. According to the linear movement of the translation cam 302, the abutting portion 284 of the pivoting member 280 is pressed against the translation cam 302, and the pressing portion 286 of the pivoting member 280 presses the developing pressed boss 260 of the developing cartridge 208 in a direction in which the developing roller 207 is separated from the photosensitive drum 205. This enables the developing roller 207 to be separated from the photosensitive drum 205. As the translation cam 302 is linearly moved from this state, the pressing of the abutting portion 284 of the pivoting member 280 by the translation cam 302 is released, and the pressing of the developing pressed boss 260 of the developing cartridge 208 by the pressing portion 286 of the pivoting member 280 is released.

Accordingly, as the pivoting member 280 is supported by the first supporting shaft 239 provided in the drum unit 204, and the pivoting member 280 rotates with the first supporting shaft 239 as a fulcrum, the developing roller 207 is separated from the photosensitive drum 205. Therefore, even if a pressing force is applied to the pivoting member 280 from the translation cam 302, the pressing force does not act on the drum unit 204 directly. As a result, when the developing roller 207 is separated from the photosensitive drum 205, the drum unit 204 can be prevented from deviating with respect to the body casing 202.

Additionally, when the pressing of the developing pressing boss 260 of the developing cartridge 208 by the pressing portion 286 of the pivoting member 280 is released, the pressing portion 286 moves in a direction to be separated from the developing pressed boss 260 by the biasing force of the spring portion 287. Accordingly, the posture of the pivoting member 280 can be stably maintained in a position where the pressing portion 286 of the pivoting member 280 does not press the developing pressed boss 260 of the developing cartridge 208.

Additionally, the spring portion 287 abuts the drum unit 204 (the abutting wall 289) to resiliently deform. This enables the biasing force of the spring portion 287 to act effectively on the pivoting member 280.

Additionally, the pivoting member 280 includes the guide portion 283. The guide portion 283 inclines in the width direction such that an inside part of the guide portion 283 in the width direction is lower than an outside part of the guide portion 283. Accordingly, when the cartridge 208 is mounted to the drum unit 204, the developing cartridge 208 is guided inward in the width direction by moving the developing pressed boss 260 of the developing cartridge 208 along the guide portion 283. Therefore, the developing cartridge 208 can be easily aligned in the width direction.

Additionally, the body casing 202 has the body reference shaft 292 which extends in the axial direction of the photosensitive drum 205. The drum unit 204 abuts the body reference shaft 292 in a state where the drum unit is mounted into the body casing 202. Accordingly, the drum unit 204 is positioned with respect to the body casing 202. The direction of a pressing force input to the abutting portion 284 of each pivoting member 280 from the translation cam 302 is substantially same as the direction (substantially the front-rear direction) in which the drum unit 204 abuts on the body reference shaft 292. Therefore, even if a force acts on the drum unit 204 via the pivoting member 280 from the translation cam 302, the force is along the substantially same direction as the direction in which the drum unit 204 abuts the body reference shaft 292. Consequently, when the developing roller 207 is separated from the photosensitive drum 205, the drum unit 204 can be prevented from deviating with respect to the body casing 202.

Additionally, the cam portion 306 for pressing the abutting portion 284 of the pivoting member 280 is provided in the translation cam 302 for each pivoting member 280. When the cam portion 306 is abutted on the abutting portion 284 of the pivoting member 280, the abutting portion 284 of the pivoting member 280 is pressed by the cam portion 306. On the other hand, when the cam portion 306 is separated from the abutting portion 284 of the pivoting member 280, the pressing of the abutting portion 284 of the pivoting member 280 by the cam portion 306 is released. Therefore, by the simple construction in which the translation cam 302 is provided with the cam portion 306, the pivoting member 280 can be rotated and the developing roller 207 can be separated from the photosensitive drum 205.

Additionally, the linear movement of the translation cam 302 allows switching to a first state where all the cam portions 306 abut the abutting portions 284 of the pivoting members 280, a second state where the cam portion 306 corresponding to the developing cartridge for black abuts the abutting portion 284 of the pivoting member 280, and the other cam portions 306 are separated from the abutting portions 284 of the pivoting members 280, and a third state where all the cam portions 306 are separated from the abutting portions 284 of the pivoting members 280.

Additionally, the developing cartridges 208 are provided corresponding to black, yellow, magenta, and cyan colors, respectively. In the first state, as the cam portions 306 abut the abutting portions 284 of the pivoting members 280 for all the colors, respectively, the developing rollers 207 for all the colors are separated from the photosensitive drums 205. In the second state, as the cam portions 306 abut the abutting portions 284 of the pivoting members 280 corresponding to yellow, magenta, and cyan, respectively, the developing rollers 207 for yellow, magenta, and cyan are separated from the photosensitive drums 205, and the developing roller 207 for black contacts the photosensitive drum 205. In the third state, as the cam portions 306 are separated from the abutting portions 284 of the pivoting members 280 for all the colors, the developing rollers 207 for all the colors contact with the photosensitive drums 205. Therefore, the wear of the developing rollers 207 for yellow, magenta, and cyan can be prevented by performing switching to the second state when a monochrome image is formed.

Additionally, the surface of abutment of the cam portion 306 onto the abutting portion 284 of the pivoting member 280 is formed on the inclined surface 307 which inclines in the width direction. Therefore, the pressing force applied to the abutting portion 284 of the pivoting member 280 from the cam portion 306 includes a force component in the width direction. Accordingly, since the force in the width direction acts on the drum unit 204, the drum unit 204 can be positioned in the width direction.

Additionally, the pressing mechanism 270 for pressing the developing cartridge 208 in a direction in which the developing roller 207 and the photosensitive drum 205 oppose each other is provided for each developing cartridge 208. The developing roller 207 can be pressed against the photosensitive drum 205 by the pressing mechanism 270. Accordingly, a toner can be fully supplied to the photosensitive drum 205 from the developing roller 207.

Additionally, the drum unit 204 is provided with the second supporting shaft 240. The pressing cam 271 is rotatably supported by the second supporting shaft 240, and the pressing cam 271 is resiliently pressed against the developing pressed boss 260 of the developing cartridge 208 by the pressing spring 272. The developing roller 207 can be pressed against the photosensitive drum 205 by this pressing.

While the present invention has been shown and described with reference to certain exemplary embodiments thereof, it will be understood by those skilled in the art that various changes in form and details may be made therein without departing from the spirit and scope of the invention as defined by the appended claims.

In the above-described exemplary embodiment, a color laser printer has been exemplified. However, the present invention is not limited thereto. The printer 201 may be a monochrome laser printer which has a single developing cartridge 208 for black.

The invention claimed is:

1. A drum unit configured to support a plurality of developing cartridges, each including a developing roller, the drum unit comprising:

a plurality of photosensitive drums;

a support portion supporting the plurality of photosensitive drums; and a plurality of contacting and spacing members provided to the support portion, each of the contacting and spacing members being configured to take a contacting position for contacting the developing roller of one of the developing cartridges to a corresponding one of the photosensitive drums and a spacing position for spacing the developing roller of the one of the developing cartridges from the corresponding one of the photosensitive drums, wherein each of the contacting and spacing members includes a pressing portion configured to press one of the developing cartridges for spacing the developing roller of the one of the developing cartridges from a corresponding one of the photosensitive drums.

2. The drum unit according to claim 1, further comprising:

a first shaft provided to an inner surface side of the support portion, wherein each of the contacting and spacing members is formed with a hole, and wherein the pressing portion of each of the contacting and spacing members is configured to be rotated about the first shaft inserted into the hole of the contacting and spacing member.

3. The drum unit according to claim 1, wherein each of the contacting and spacing members further includes:

a main body having a triangular shape, and an abutting portion provided to an upper end edge of the main body and configured to receive a force for spacing the developing roller of one of the developing cartridges from a corresponding one of the photosensitive drums.

4. The drum unit according to claim 3, wherein the abutting portion is provided further to an upper side than the pressing portion in each of the contacting and spacing members.

5. The drum unit according to claim 3, further comprising:

a spring portion provided to an edge different from the upper end edge of the main body of each of the contacting and spacing members; and a first shaft provided to an inner surface side of the support portion, wherein each of the contacting and spacing members is formed with a hole to which the first shaft is inserted, the hole being provided between the abutting portion and the spring portion.

6. The drum unit according to claim 1, wherein the pressing portion opposes one of the photosensitive drums and a predetermined portion of one of the developing cartridges and is configured to press the predetermined portion of the one of the developing cartridges.

7. The drum unit according to claim 6, wherein each of the contacting and spacing members includes a spring portion.

8. The drum unit according to claim 7, wherein the spring portion is provided with a projection at a lower end thereof, and wherein the projection is configured to abut an abutting wall of the drum unit such that the spring portion causes one of the contacting and spacing members to pivot.

9. The drum unit according to claim 7, wherein each of the contacting and spacing members includes a main body, and wherein the spring portion extends vertically downward from an end edge of the main body.

10. The drum unit according to claim 9, wherein the spring portion is integrally formed with the main body.

11. A drum unit configured to support a developing cartridge including a developing roller, the drum unit comprising:

a photosensitive drum;

a support portion supporting the photosensitive drum;

a contacting and spacing member provided to the support portion and is configured to take a contacting position for contacting the developing roller to the photosensitive drum and a spacing position for spacing the developing roller from the photosensitive drum;

a pressing cam being movable between a first position and a second position different from the first position; and a pressing spring pressing the pressing cam in a predetermined direction, wherein the contacting and spacing member includes a pressing portion configured to press the developing cartridge for spacing the developing roller from the photosensitive drum, and wherein the pressing portion is configured to space the developing roller from the photosensitive drum against a pressing force by the pressing spring.

12. The drum unit according to claim 11, further comprising:

a first shaft provided to an inner surface side of the support portion, wherein the contacting and spacing member is formed with a hole, and wherein the pressing portion is configured to be rotated about the first shaft inserted into the hole.

13. The drum unit according to claim 11, wherein the contacting and spacing member further includes:

a main body having a triangular shape, and an abutting portion provided to an upper end edge of the main body and configured to receive a force for spacing the developing roller from the photosensitive drum.

14. The drum unit according to claim 13, wherein the abutting portion is provided further to an upper side than the pressing portion.

15. The drum unit according to claim 13, further comprising:

a spring portion provided to an edge different from the upper end edge of the main body of the contacting and spacing member; and a first shaft provided to an inner surface side of the support portion, wherein the contacting and spacing member is formed with a hole to which the first shaft is inserted, the hole being provided between the abutting portion and the spring portion.

16. The drum unit according to claim 11, wherein the pressing portion opposes the photosensitive drum and a predetermined portion of the developing cartridge and is configured to press the predetermined portion of the developing cartridge.

17. The drum unit according to claim 16, wherein the contacting and spacing member includes a spring portion.

18. The drum unit according to claim 17, wherein the spring portion is provided with a projection at a lower end thereof, and wherein the projection is configured to abut an abutting wall of the drum unit such that the spring portion causes the contacting and spacing member to pivot.

19. The drum unit according to claim 17, wherein the contacting and spacing member includes a main body, and wherein the spring portion extends vertically downward from an end edge of the main body.

20. The drum unit according to claim 19, wherein the spring portion is integrally formed with the main body.

* * * * *